US010669729B2

(12) United States Patent
Ebady et al.

(10) Patent No.: US 10,669,729 B2
(45) Date of Patent: Jun. 2, 2020

(54) OBJECT PLACEMENT AND FASTENING AID

(71) Applicants: Ilyasullah Sayed Ebady, Lansdale, PA (US); Atiqullah Sayed Ebady, Lansdale, PA (US)

(72) Inventors: Ilyasullah Sayed Ebady, Lansdale, PA (US); Atiqullah Sayed Ebady, Lansdale, PA (US)

( * ) Notice: Subject to any disclaimer, the term of this patent is extended or adjusted under 35 U.S.C. 154(b) by 0 days.

(21) Appl. No.: 15/476,104

(22) Filed: Mar. 31, 2017

(65) Prior Publication Data

US 2018/0281158 A1 Oct. 4, 2018

(51) Int. Cl.
*E04G 21/16* (2006.01)
*E04G 21/18* (2006.01)

(52) U.S. Cl.
CPC ..... *E04G 21/1891* (2013.01)

(58) Field of Classification Search
CPC ..... B25B 11/02; E04F 21/00; E04F 2201/01; E04F 2201/0505; E04G 21/1891
USPC ..... 33/474, 480, 481, 562, 613, 645; 269/40–42; 52/749.1, 749.11, 749.12, 52/749.13
See application file for complete search history.

(56) References Cited

U.S. PATENT DOCUMENTS 3,662,985 A * 5/1972 Parker ..... E04G 13/00 249/194
5,348,066 A * 9/1994 Wilson ..... E04F 19/02 144/344
5,558,269 A * 9/1996 Wallace ..... B44C 5/08 228/49.1
6,327,786 B1 * 12/2001 Felix ..... B25H 7/00 33/474
6,391,144 B1 * 5/2002 Gilbert, Jr. ..... B25B 5/142 156/304.1
6,729,033 B2 * 5/2004 Jevons ..... B25B 5/142 33/481
7,591,076 B2 * 9/2009 Varnedoe ..... B23K 37/0443 33/481
8,191,335 B2 * 6/2012 Davis ..... E04G 21/1891 33/613
9,062,467 B1 * 6/2015 Hanson ..... E04G 21/1891
10,132,093 B2 * 11/2018 Woodruff ..... E04G 21/1891
2007/0245582 A1 * 10/2007 Bittner ..... G01B 3/566 33/474
2008/0006976 A1 * 1/2008 Riley ..... E04F 21/18 269/43
2008/0250905 A1 * 10/2008 Khan ..... B27B 27/08 83/23

(Continued)

*Primary Examiner* — William V Gilbert

(57) ABSTRACT

A tool (FIG. 1) that assists in the placement and fastening together of pieces of material. The invention is comprised of valleys into which said pieces are placed. Said valleys have openings (portals) so that the exposed face of one piece can be aligned flush with the exposed face of another piece. The portals also allow an adequate means of fastening such as nails, screws, adhesive, etc. to be used to fasten them together at a predetermined angle. The invention may have multiple protruding valleys extending from a main valley, so that a base piece of material may have several pieces of material fastened to it—such as in framing the studs of a wall unit—without measuring distances or angles between pieces, thus saving considerable time, labor, and money.

1 Claim, 8 Drawing Sheets

(56) References Cited

U.S. PATENT DOCUMENTS

2011/0214389 A1* 9/2011 Paton ..... E04G 21/16
52/749.1
2017/0328074 A1* 11/2017 Ayvazian ..... E04G 21/1891

* cited by examiner

OBJECT PLACEMENT AND FASTENING AID

BACKGROUND

One of the most common tasks in construction, and carpentry in particular, is the placement and fastening together of pieces of material. In many cases, such as framing wall studs, the studs must be placed apart at standard distances, such as sixteen inches on center, and the pieces must be fastened perpendicular to one another. This task is often repeated many times over in a single project.

Certain tools, such as a measuring tape, have highlighted markings to assist in measuring industry standard distances, such as the standard distance between wall studs. However, these tools are limited to assisting in measurement only. They do not reduce the labor or skill required in many aspects of the placement and fastening tasks.

SUMMARY

The invention assists in placing and fastening objects together at predetermined distances and angles by reducing the amount of skill and experience required to perform the task. The invention may be manufactured to predetermined angles and to accommodate various measurement standards, such as for standard distances between studs. The invention assists in securely holding said pieces in place for less strenuous fastening of said pieces, and saves time by eliminating steps that are common in the placement and fastening of said pieces.

The invention allows users that have minimal or no construction experience to perform tasks that require a significant amount of construction experience. Some advantages of the invention are:

(1) Reduces the knowledge, experience, expertise, and skills needed to place and fasten objects together at specific measurements and angles by eliminating tasks that require said skills.
(2) Eliminating tasks in the work process saves considerable time, labor, and money.
(3) Allows said objects of varying material composition to be placed together and fastened together with greater ease by providing a means for said objects to be held in place without the need for secondary tools or additional personnel assistance.
(4) Improves the flush joining of the surfaces of said pieces.
(5) Reduces human error across many aspects of the placement and fastening processes, such as measuring distances and aligning said pieces at specific angles.
(6) Allows objects to be securely held and fastened together at predetermined angles.
(7) Eliminates the need to measure distances between objects by allowing secure placement of dimensional objects at predetermined distances.

DRAWINGS

Figure 5:
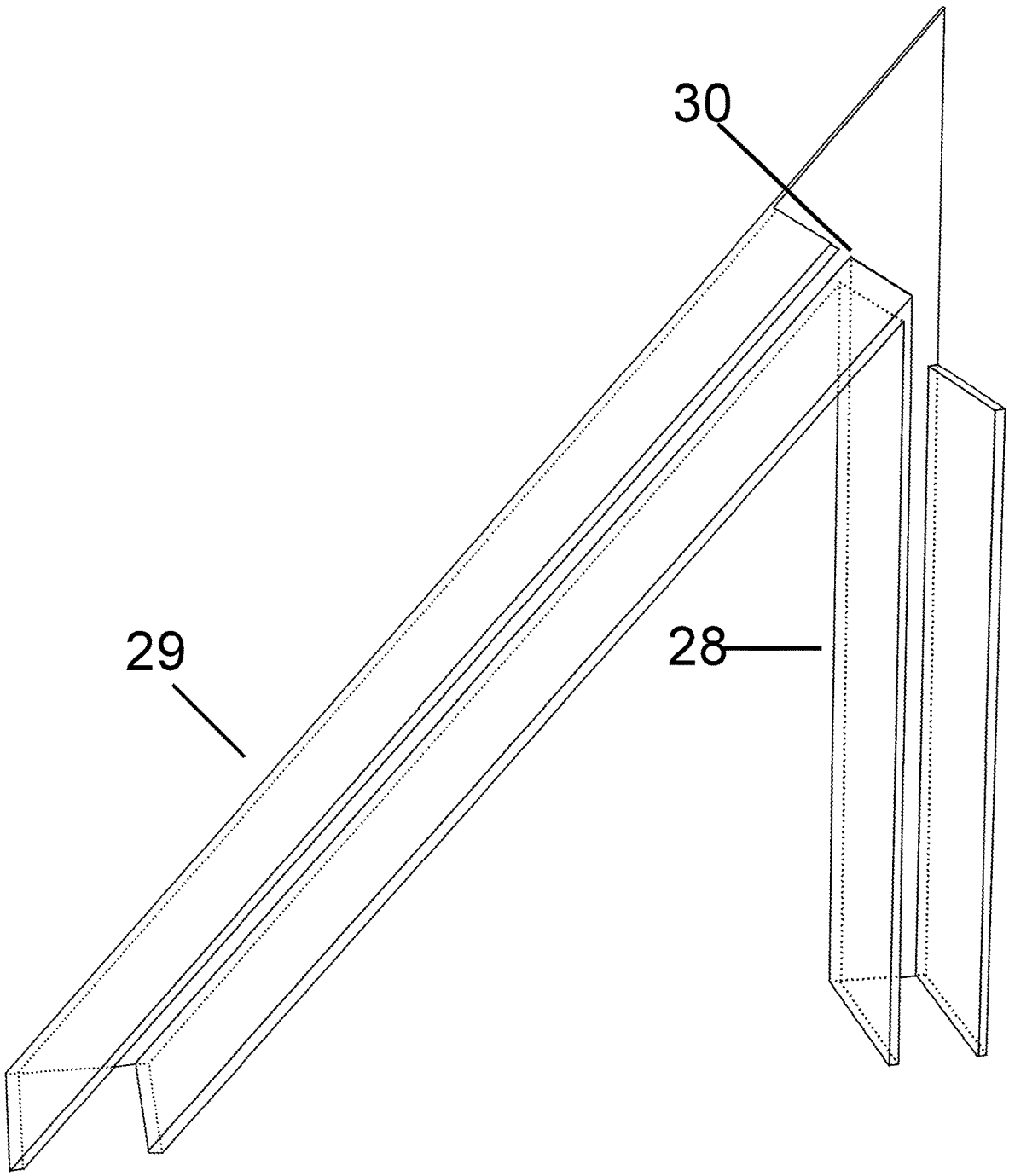

FIG. 5 is a perspective top view of another variation of the invention, having a protruding valley 29 extending at an acute angle 30 from the main valley 28.

Figure 6:
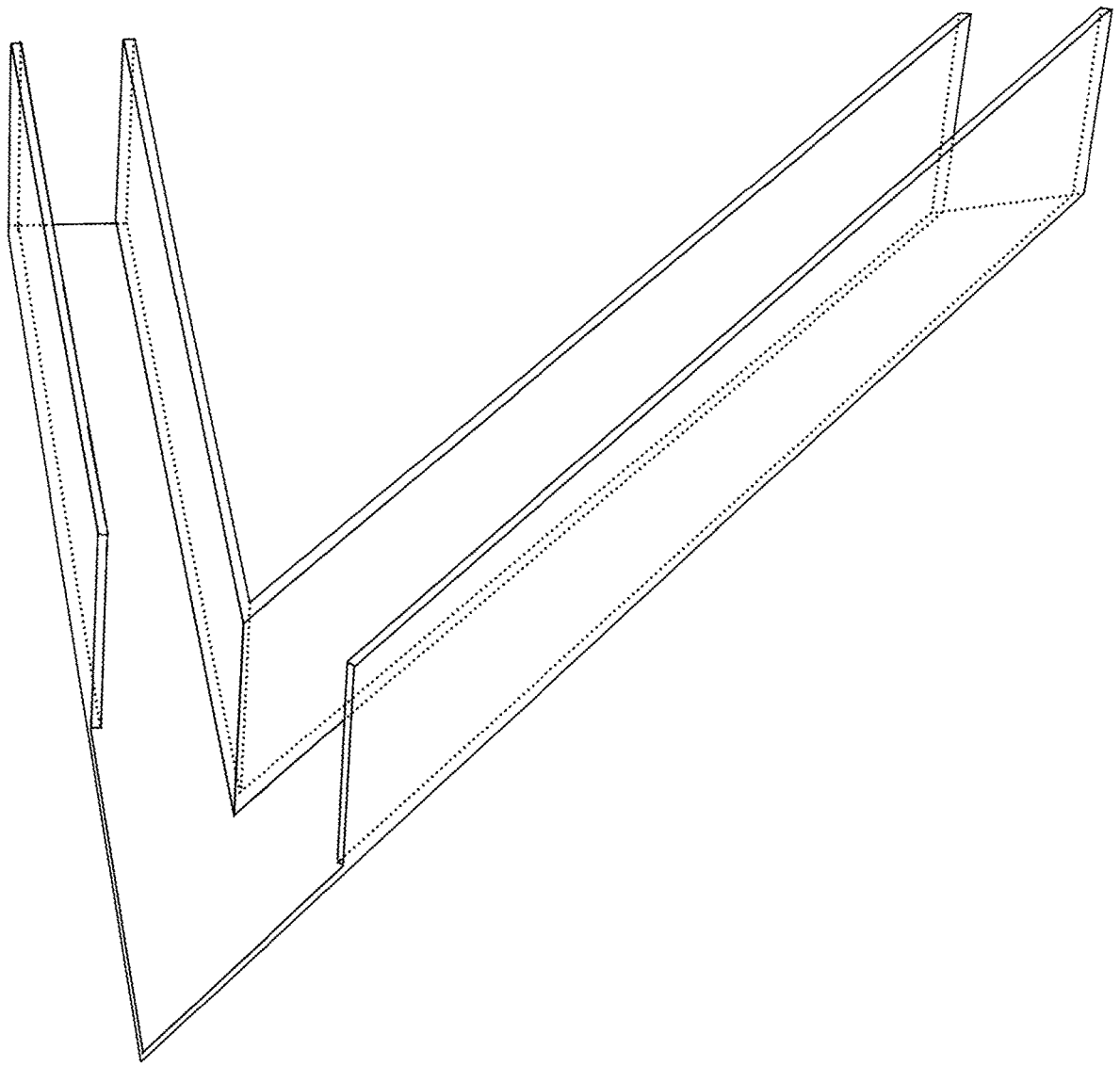

FIG. 6 is an angular view of the variation of the invention shown in FIG. 5.

Figure 7A:
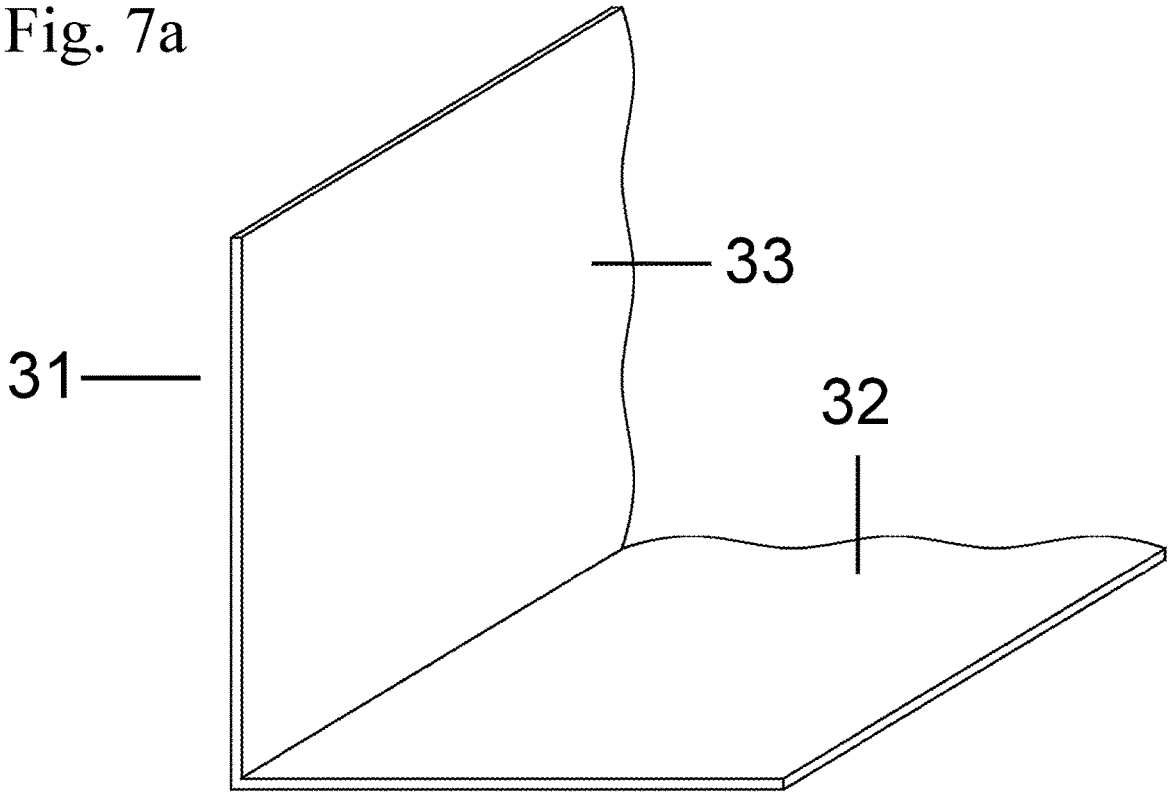

FIG. 7*a* is a cross section of another variation of the invention, having one outer wall 33.

Figure 7B:
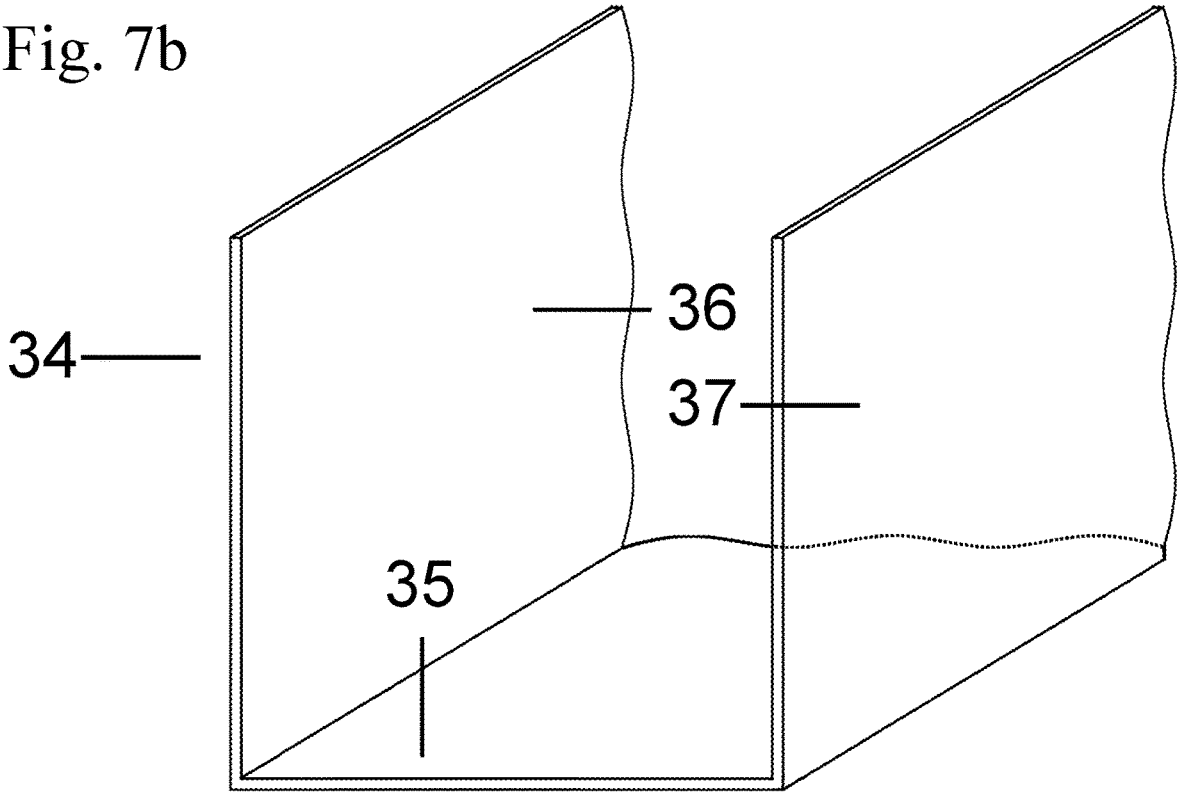

FIG. 7*b* is a cross section of another variation of the invention, having two outer walls 36 and 37.

Figure 8:
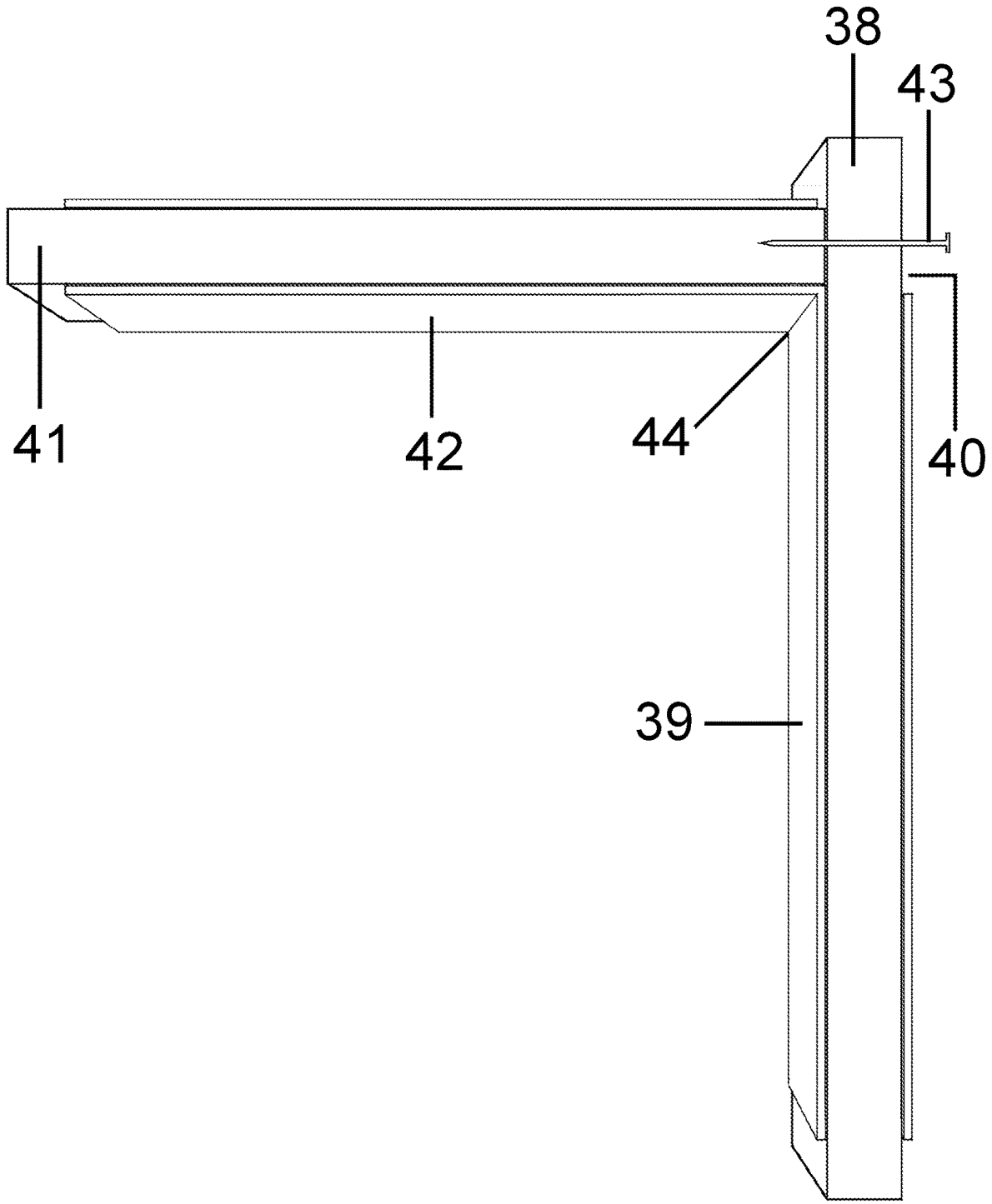

FIG. 8 shows the invention being used in a common task of placing and fastening two pieces of material 38, 41.

DESCRIPTION

The invention may be constructed from one or more pieces of material, and it may be composed of a single type of material, such as wood, plastic, metal, etc. or it may be a combination of said materials.

Figure 1:
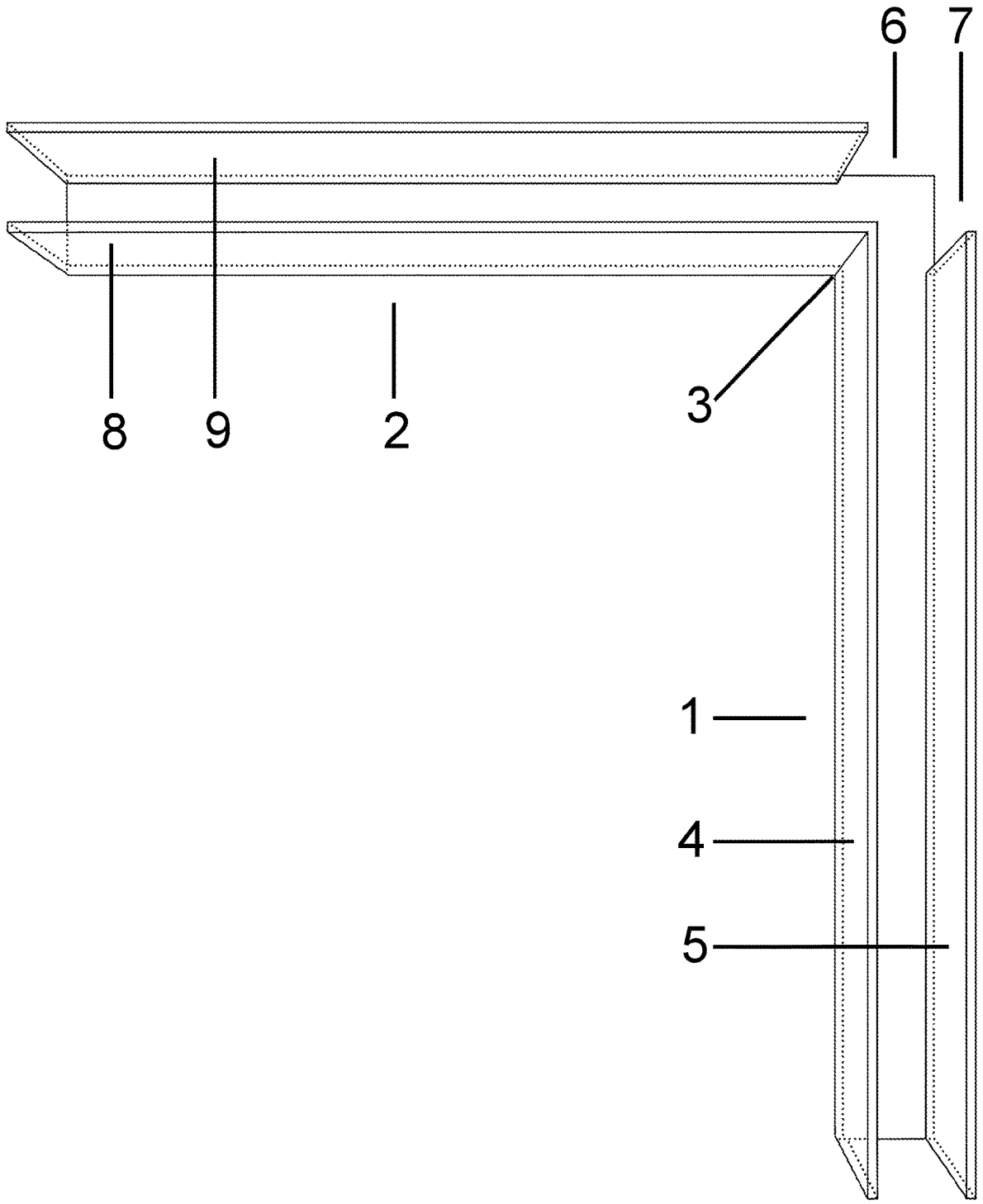
FIG. 1 is a perspective top view of one variation of the invention.
Figure 2:
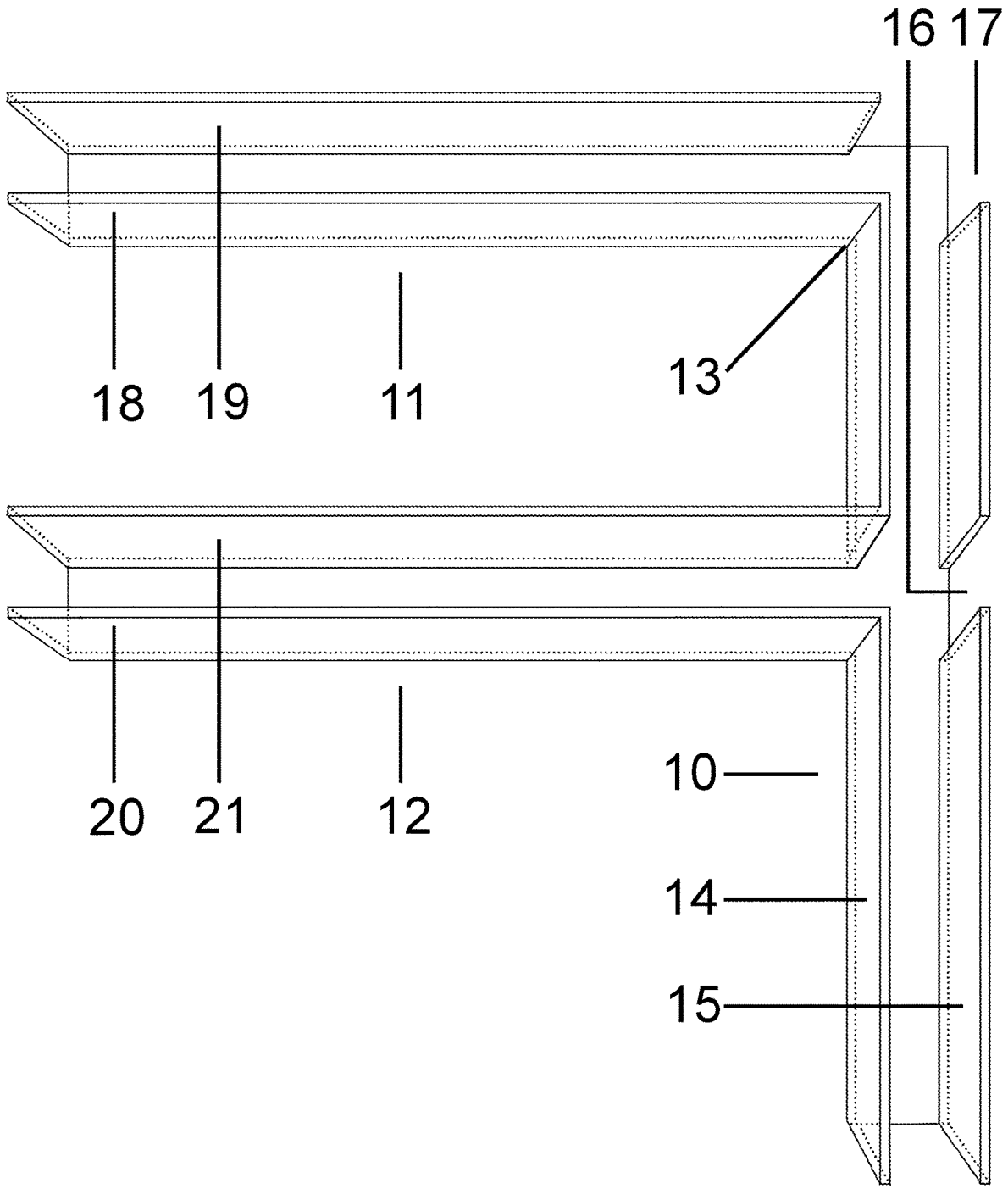
FIG. 2 is a perspective top view of another variation of the invention, having multiple protruding valleys.

The invention may be comprised of at least one valley, said valley having at least one wall and at least one portal. When there are two valleys (FIG. 1), one shall be called the main valley 1 (FIG. 1), and the other is the protruding valley 2 (FIG. 1). When there are three or more valleys (FIG. 2), the main valley 10 (FIG. 2) shall be the valley from which other valleys 11, 12 (FIG. 2) extend out, and the valleys extending out from the main valley shall be called protruding valleys 11, 12 (FIG. 2). A protruding valley is such that its base is connected to the base of said main valley creating a vertex 13 (FIG. 2), and said protruding valley extends away from said main valley at a predetermined angle.

Each valley 31 (FIG. 7) is comprised of a base 32 (FIG. 7) and at least one wall 33 (FIG. 7) rising vertically from the base at a predetermined angle and to a predetermined height. When viewed at a cross-section, the valley would have an L-shape 31 (FIG. 7). A valley 34 (FIG. 7) may also be comprised of a base 35 (FIG. 7) and two walls 36, 37 (FIG. 7) rising vertically from either side of the base. In this variation of the invention, the valley would have a U-shape 34 (FIG. 7).

A portal 6, 7 (FIG. 1) is an open space in a wall or base of a valley. A portal 16, 17 (FIG. 2) may be located at any place along the length of a base or wall. A portal is primarily located along a wall of the main valley, and it is the opening that allows an adequate means of fastening, such as screws, nails, bolts, etc. to be driven horizontally through a base piece of material into a second piece of material in order to fasten said pieces together. Said screws, nails, bolts, etc. may also be inserted from any exposed face of said pieces of material.

Operation

A first piece of material is placed in the main valley. A second piece of material is placed in a protruding valley. Said second piece is moved towards the vertex of the main valley and the protruding valley so that it rests flush against said first piece. Said first piece and said second piece may then be fastened together by various means, such as inserting a nail or screw through said first piece at the portal that is opposite to where said second piece is aligned with said first piece, said nail or screw being of sufficient length to fasten said first piece to said second piece. If the variation of the invention has multiple protruding valleys (FIG. 2), then additional pieces of material may be similarly fastened to said first piece at the additional protruding valleys. If the variation of the invention has only one protruding valley, then said pieces may be removed from the invention, and the invention may be secured at another location along the first piece to fasten additional pieces of material to said first piece.

In one variation of the invention (FIG. 8), a first piece of lumber 38 (FIG. 8) is placed in the main valley 39 (FIG. 8) so that one end of said first piece covers the portal 40 (FIG. 8). A second piece of lumber 41 (FIG. 8) is then placed in the protruding valley 42 (FIG. 8) and moved horizontally towards vertex 44 (FIG. 8) so that one end of said second piece 41 rests flush against said first piece 38. An adequate means of fastening, such as a nail, screw, etc. 43 (FIG. 8) is then inserted into said first piece 38 at said portal 40, said nail or screw 43 being of sufficient length to penetrate said first piece 38 and penetrate through to said second piece 41, thus fastening said pieces together. Additional screws may be inserted through said first piece 38 in similar fashion.

In another variation of the invention (FIG. 2), additional protruding valleys 11, 12 (FIG. 2) may be spaced sixteen inches apart on-center. A first piece of lumber may be placed in the main valley 10 (FIG. 2) so that it covers both portals 16, 17 (FIG. 2). A second piece of lumber may be placed in the first protruding valley 11 (FIG. 2) so that it is flush against said first piece and fastened to said first piece at the portal 17 (FIG. 2). When a third piece of dimensional lumber is placed in the other protruding valley 12 (FIG. 2) and fastened to said first piece at the portal 16 (FIG. 2), said second piece and said third piece shall be sixteen inches apart on-center. If the standard distance between studs were to be sixteen inches, this variation of the invention may be used to frame studs without measuring angles or distances, thus saving considerable time, labor, and money.

REFERENCE NUMERALS

Figure 3:
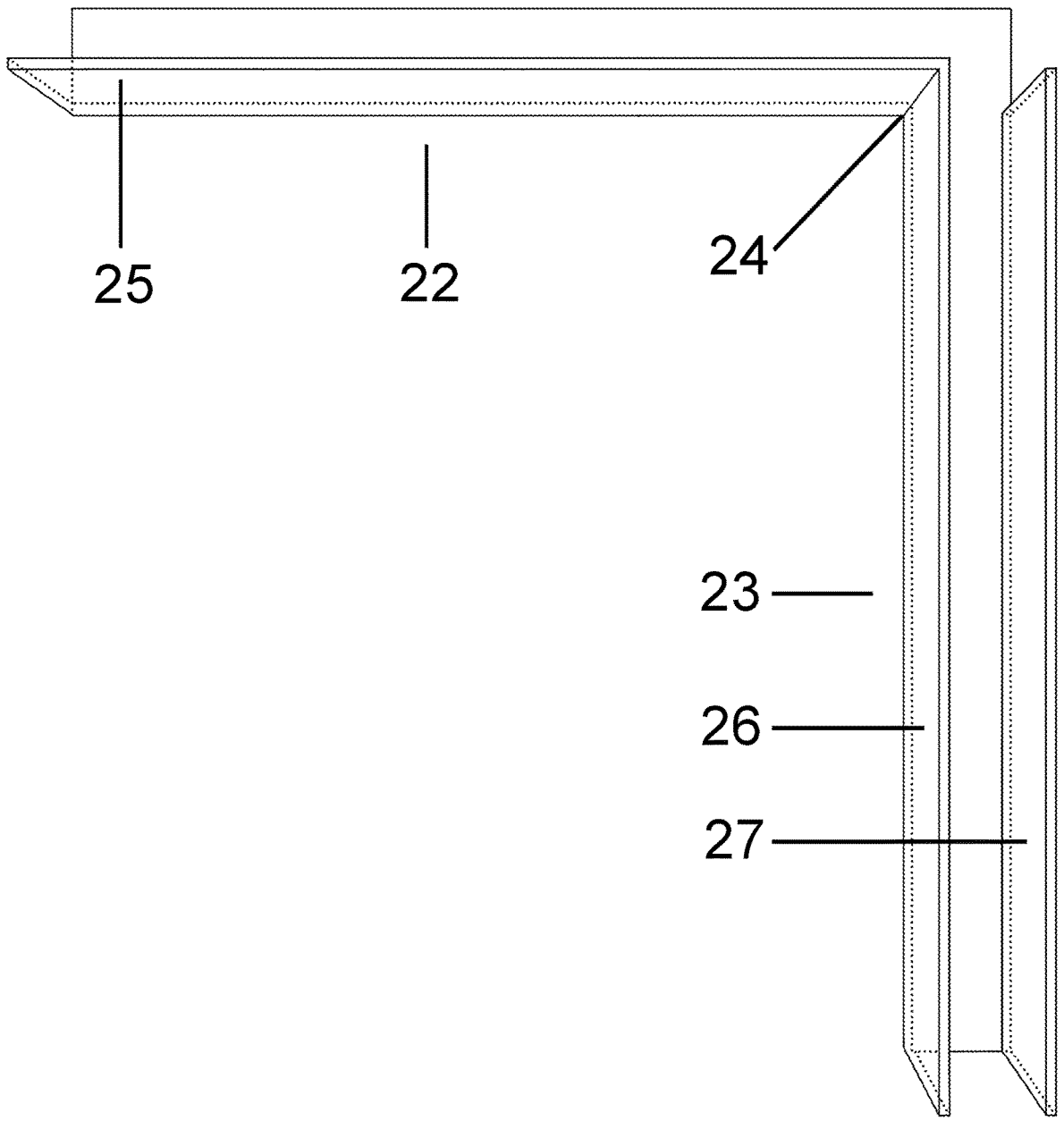
FIG. 3 is a perspective top view of another variation of the invention.
Figure 4:
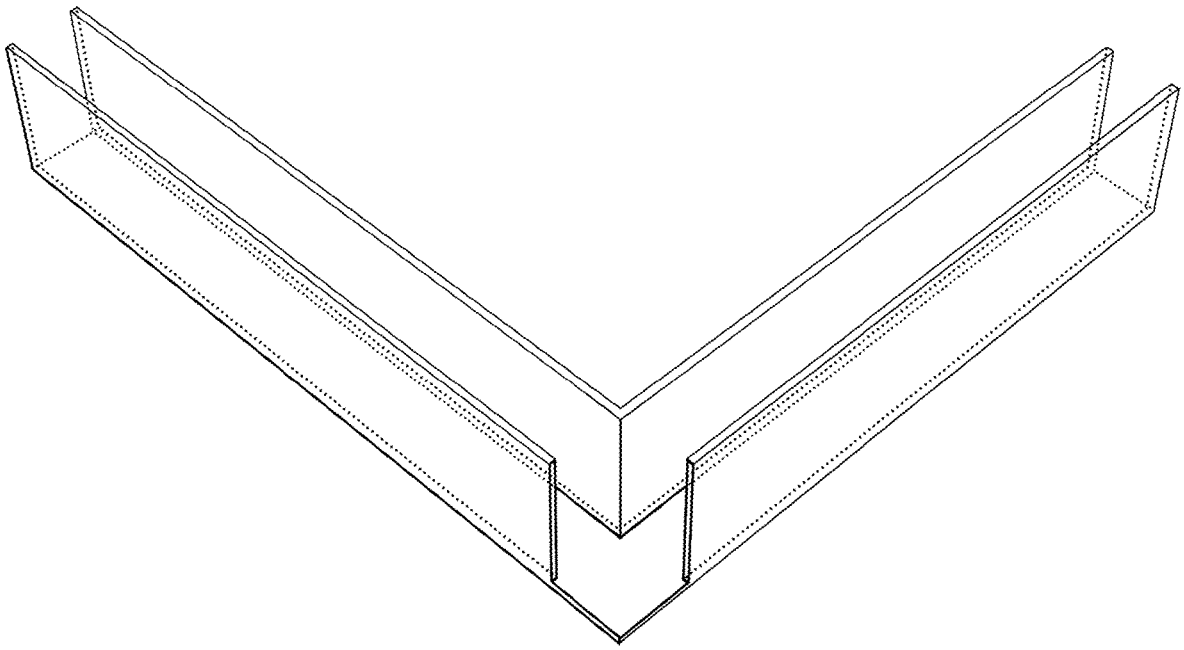
FIG. 4 is an angular view of the variation of the invention shown in FIG. 1.

1 Main valley in FIG. 1
2 Protruding valley in FIG. 1
3 Vertex of main valley and protruding valley in FIG. 1
4 Inner wall of main valley in FIG. 1
5 Outer wall of main valley in FIG. 1
6 Fastening portal in FIG. 1
7 Fastening portal in FIG. 1
8 Inner wall of protruding valley in FIG. 1
9 Outer wall of protruding valley in FIG. 1
10 Main valley in FIG. 2
11 First protruding valley in FIG. 2
12 Second protruding valley in FIG. 2
13 Vertex of main valley and first protruding valley in FIG. 2
14 Inner wall of main valley in FIG. 2
15 Outer wall of main valley in FIG. 2
16 Second portal in FIG. 2
17 First portal in FIG. 2
18 Inner wall of first protruding valley in FIG. 2
19 Outer wall of first protruding valley in FIG. 2
20 Inner wall of second protruding valley in FIG. 2
21 Outer wall of second protruding valley in FIG. 2
22 Main valley in FIG. 3
23 Protruding valley in FIG. 3
24 Vertex of main valley and protruding valley in FIG. 3
25 Inner wall of main valley in FIG. 3
26 Inner wall of protruding valley in FIG. 3
27 Outer wall of protruding valley in FIG. 3
28 Main valley in FIG. 5
29 Protruding valley in FIG. 5
30 Vertex of main valley and protruding valley in FIG. 5
31 Cross-section of L-shaped valley in FIG. 7
32 Base of L-shaped valley in FIG. 7
33 Wall of L-shaped valley in FIG. 7
34 Cross-section of U-shaped valley in FIG. 7
35 Base of U-shaped valley in FIG. 7
36 One wall of U-shaped valley in FIG. 7
37 Other wall of U-shaped valley in FIG. 7
38 Main piece in FIG. 8
39 Main valley in FIG. 8
40 Portal in FIG. 8
41 Second piece in FIG. 8
42 Protruding valley in FIG. 8
43 An adequate means of fastening, such as a nail, screw, bolt, etc.
44 Vertex of main valley and protruding valley in FIG. 8

The invention claimed is:

1. A device aiding in the construction of assemblies comprising:

a composition of rigid material, a main valley having a valley base, said valley base having a first end and a second end opposite said first end, a first longitudinal edge and a second longitudinal edge opposite said first longitudinal edge, said main valley having a first wall connected to said first longitudinal edge with a first longitudinal end and a second longitudinal end opposite said first longitudinal end and defining a first gap therebetween, said main valley further having a second wall connected to said second longitudinal edge with a first longitudinal end and a second longitudinal end opposite said first longitudinal end of said second wall and defining a second gap therebetween, said first gap and said second gap being spaced substantially equidistant from said first longitudinal end of said valley base, a first valley proximate said first end of said main valley and extending perpendicularly from said main valley and having a first base member, a first longitudinal wall extending along a first longitudinal edge of said first base member and a second longitudinal wall extending along a second longitudinal edge of said first base member, a first end of said first longitudinal wall of said first valley being unattached and a first end of said second longitudinal wall of said first valley being connected to a first end of said first longitudinal wall of said main valley, a second valley extending perpendicularly from said main valley and extending parallel to said first valley and having a second base member, a first longitudinal wall extending along a first longitudinal edge of said second base member and a second longitudinal wall extending along a second longitudinal edge of said second base member, a first longitudinal end of said first longitudinal wall of said second valley being connected to a first end of said gap of said first longitudinal wall of said main valley, and a first end of said second longitudinal wall of said second valley being connected to a second end of said gap of said first longitudinal wall of said main valley, whereby said device is configured to hold a main piece of material placed in said main valley against a first additional piece of material placed in said first valley and/or a second additional piece of material placed in said second valley so that said first additional piece of material and/or said second additional piece of material can be fastened to said main piece.

* * * * *